US005719946A

United States Patent [19]

Terauchi et al.

[11] Patent Number: 5,719,946

[45] Date of Patent: Feb. 17, 1998

[54] LOUDSPEAKER FOR HIGHER AUDIO FREQUENCIES AND A MANUFACTURING METHOD THEREOF

[75] Inventors: Shouichiro Terauchi; Tomohiro Suenaga; Masaharu Yoneyama; Takanobu Saito, all of Saitama-ken, Japan

[73] Assignee: Pioneer Electronic Corporation, Tokyo, Japan

[21] Appl. No.: 510,459

[22] Filed: Aug. 2, 1995

[30] Foreign Application Priority Data

Sep. 5, 1994 [JP] Japan ..... 6-246680

[51] Int. Cl.[6] ..... H04R 25/00

[52] U.S. Cl. ..... 381/195; 381/194; 381/204; 181/163

[58] Field of Search ..... 29/609.1; 381/195, 381/184, 186, 193, 202, 197, 204; 181/163, 164, 165, 171, 172

[56] References Cited

U.S. PATENT DOCUMENTS

| | | | |
|---|---|---|---|
| 3,578,104 | 5/1971 | Sotome | 181/32 |
| 3,665,124 | 5/1972 | Sotome | 381/195 |
| 3,772,466 | 11/1973 | Hossbach | 381/184 |
| 3,833,085 | 9/1974 | Thomasen | 381/204 |
| 4,283,606 | 8/1981 | Buck | 381/204 |
| 4,315,112 | 2/1982 | Hofer | 381/186 |
| 4,427,845 | 1/1984 | Yoshida | 381/195 |
| 4,477,699 | 10/1984 | Wada et al. | 381/184 |
| 4,550,797 | 11/1985 | Suzuki et al. | 181/167 |
| 4,590,333 | 5/1986 | Strohbeen | 381/195 |
| 4,709,392 | 11/1987 | Kato et al. | 381/193 |
| 4,720,868 | 1/1988 | Hirano | 381/195 |
| 4,783,824 | 11/1988 | Kobayashi | 381/195 |
| 4,821,330 | 4/1989 | Pfleiderer | 381/184 |
| 5,099,949 | 3/1992 | Mitobe | 181/171 |
| 5,157,731 | 10/1992 | Mitobe | 381/202 |
| 5,295,194 | 3/1994 | Christensen | 381/195 |
| 5,425,107 | 6/1995 | Bertagni et al. | 381/186 |
| 5,583,945 | 12/1996 | Iijima et al. | 381/204 |

*Primary Examiner*—Curtis Kuntz
*Assistant Examiner*—Rexford N. Barnie
*Attorney, Agent, or Firm*—Sughrue, Mion, Zinn, Macpeak & Seas, PLLC

[57] ABSTRACT

A loudspeaker has a first diaphragm having a domed shape, a second diaphragm formed on a periphery of the first diaphragm, and a voice coil provided at a juncture of the first and second diaphragms. The second diaphragm is designed such that a dip frequency by shape effect thereof is positioned at a frequency higher than a high limit frequency of the first diaphragm.

9 Claims, 23 Drawing Sheets

(CERAMICS DOMED DIAPHRAGM)

(CERAMICS CONICAL DIAPHRAGM)

(CERAMICS COMPOSITE CHARACTERISTIC)

(CERAMICS DOMED DIAPHRAGM)

(CERAMICS CONICAL DIAPHRAGM)

(TITANIUM CONICAL DIAPHRAGM)

LOUDSPEAKER FOR HIGHER AUDIO FREQUENCIES AND A MANUFACTURING METHOD THEREOF

BACKGROUND OF THE INVENTION

The present invention relates to a loudspeaker for higher audio frequencies and a method for manufacturing the loudspeaker, and more particularly to a loudspeaker which has a flat frequency characteristic in an ultra-high frequency range which is higher than a high limit frequency.

In a loudspeaker of an audio system, it is desired to increase a dynamic range and a reproduction band. As a loudspeaker for higher audio frequencies, a dome type loudspeaker is widely used. However, it is difficult to obtain a flat frequency characteristic in an ultra-high frequency range.

FIG. 20 shows a conventional dome type loudspeaker. The loudspeaker has a yoke 1, an annular magnet 3 mounted on the yoke 1, and an annular plate 2 mounted on the magnet 3. A back cover 4*a* is secured to a base portion of the yoke 1 so as to define a back chamber 4. On the annular plate 2 is mounted an annular packing 9 which supports a domed diaphragm 6 around an edge 8 thereof. A lower edge of the diaphragm 6 is disposed in a magnetic gap 5 formed between the yoke 1 and the annular plate 2 and secured to a voice coil 7. An equalizer 10 is provided on the domed diaphragm 6 and secured to the packing 9 at a periphery thereof.

The domed diaphragm 6 is a hard type and mainly made of metal as a hard type dome loudspeaker, such as beryllium, aluminum, and titanium. As other materials, a high-elasticity material such as ceramic graphite and diamond has been developed. Since the beryllium has a high rigidity, a high limit frequency is increased.

As a soft dome type loudspeaker, a domed diaphragm made of cloth such as cotton, silk and chemical fiber which are soaked with phenol is used.

The dome type loudspeaker is operated basically in the same manner as a cone type loudspeaker. A difference of the operating principle between the dome type loudspeaker and a cone type loudspeaker is that the cone type loudspeaker is operated to vibrate a neck of a conical diaphragm, and that the dome type loudspeaker is operated to vibrate an outer periphery of the domed diaphragm.

FIG. 21 shows a sound pressure characteristic of the loudspeaker. The domed diaphragm 6 is vibrated in a steady state at a predetermined frequency range. In a range higher than a high limit frequency fh, a joint portion between the diaphragm 6 and the voice coil 7 vibrate in a disordered state so as to produce a peak at a resonance frequency. On the other hand, the sound pressure characteristic is rapidly decreased due to deterioration of transmissibility of vibration of the voice coil.

Furthermore, as shown in FIG. 22, the diaphragm 6 is partially vibrated because the diaphragm can not be vibrated integrally at the high range. At a resonant frequency fp of the partial vibration, a peak generates. Accordingly, a flat frequency characteristic of a sufficient sound pressure can not be obtained in the ultra-high frequency range.

In order to solve the problems, some attempts were made. For example, a material having a high sound velocity is used for shifting the disorder and partial vibrations to a higher range. However, the problems have not been solved.

SUMMARY OF THE INVENTION

An object of the present invention is to provide a loudspeaker for higher audio frequencies and a manufacturing method thereof wherein a flat frequency characteristic having a sufficient sound pressure is obtained in an ultra-high frequency range.

According to the present invention, there is provided a loudspeaker for higher audio frequencies, comprising a first diaphragm having a domed shape, a second diaphragm formed on a periphery of the first diaphragm and supported at a peripheral edge thereof, a voice coil provided at a juncture of the first and second diaphragms.

The second diaphragm is designed such that a dip frequency by shape effect thereof is positioned at a frequency higher than a high limit frequency of the first diaphragm. The second diaphragm has such a height that a frequency corresponding to a wavelength equal to the height of the second diaphragm is positioned at a frequency higher than a high limit frequency of the first diaphragm. The first diaphragm has a weight larger than the second diaphragm.

The other objects and features of this invention will become understood from the following description with reference to the accompanying drawings.

DETAILED DESCRIPTION OF THE PREFERRED EMBODIMENTS

Figure 1:
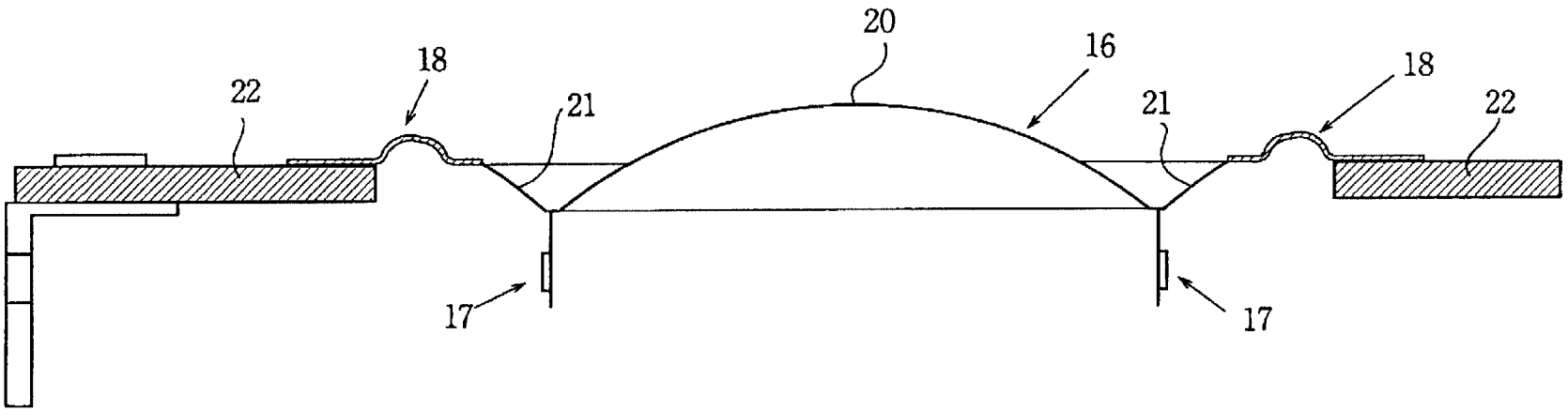
FIG. 1 is a schematic sectional view showing a loudspeaker according to the present invention.

Referring to FIG. 1, a loudspeaker of the present invention has a diaphragm unit 16 comprising a domed diaphragm 20 as a first diaphragm and an inverted conical diaphragm 21 as a second diaphragm connected to a periphery of the domed diaphragm 20 or integral with the diaphragm. A voice coil 17 is connected to a lower portion of a joint portion of the domed diaphragm 20 and the inverted conical diaphragm 21. An edge 18 attached to the conical diaphragm 21 is secured to a terminal plate 22.

Figure 20:
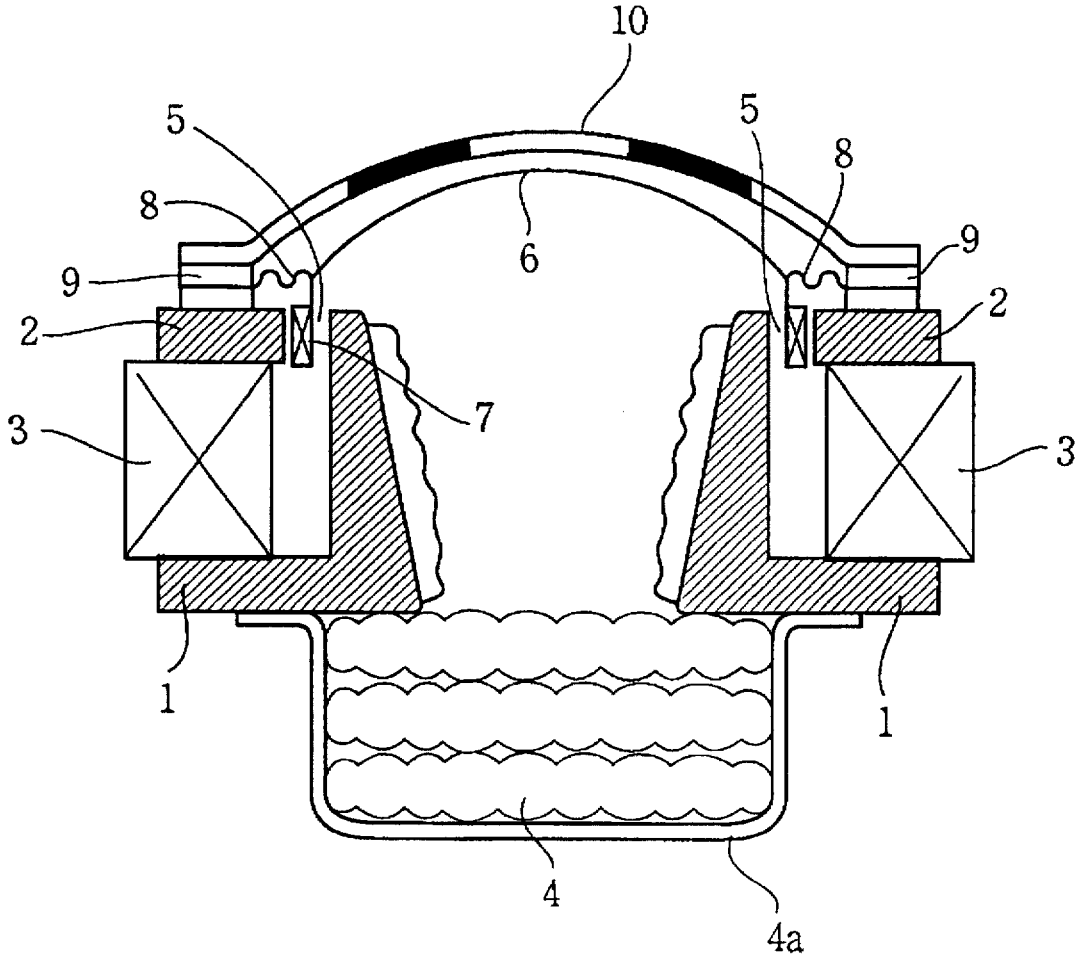
FIG.20 PRIOR ART
FIG. 20 is a sectional view showing a conventional dome type loudspeaker.
Figure 21:
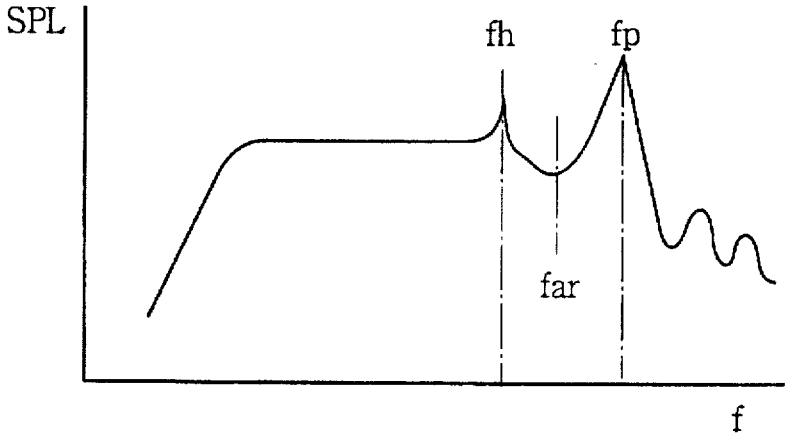
FIG.21 PRIOR ART
FIG. 21 is a diagram showing a sound pressure characteristic of the conventional loudspeaker.
Figure 22:
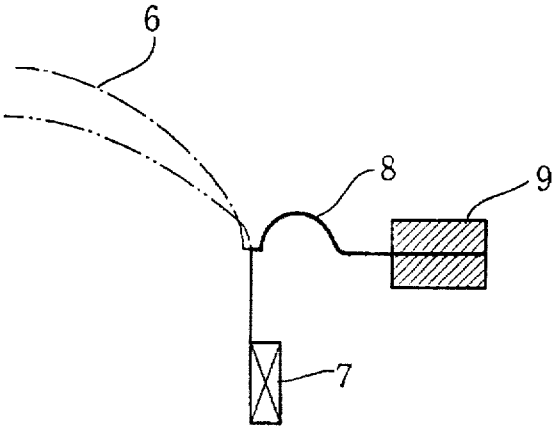
FIG.22 PRIOR ART
FIG. 22 is a schematic diagram showing a vibrating operation of a diaphragm of FIG. 20.

Other structures which are the same as the conventional loudspeaker of FIG. 20 are identified with the same reference numerals as FIG. 20 and descriptions thereof are omitted.

Figure 2:
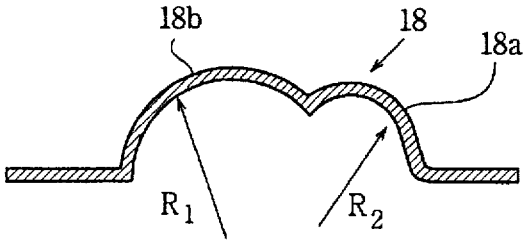
FIG. 2 is an enlarged sectional view showing an edge of a diaphragm.

Referring to FIG. 2, the edge 18 comprises two round portions 18*a* and 18*b* having different curvatures, respectively.

Figure 3:
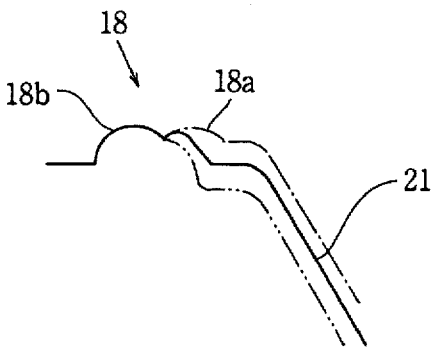
FIG. 3 is an explanatory view showing the edge in a vibrating operation.
Figure 4:
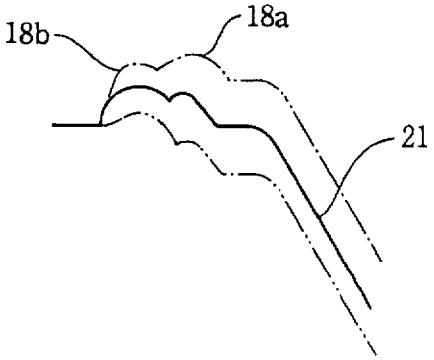
FIG. 4 is an explanatory view showing the edge in another vibrating operation.

When the diaphragm unit 16 is vibrated at a small amplitude, only the round portion 18*a* is vibrated as shown in FIG. 3. When the diaphragm unit 16 is vibrated at a large amplitude, both of the round portions 18*a* and 18*b* are vibrated as shown in FIG. 4. Thus, when the amplitude of the vibration is increased, a linearity is ensured through low and high frequency ranges, thereby increasing the low frequency range.

In the embodiment, the conical diaphragm 21 is provided to effectively operate at a frequency higher than the frequency fh so as to supplement defective sound pressures of the domed diaphragm.

The sound pressure characteristic of the diaphragm in dependency on the shape effect will be described. When the diaphragm is uniformly vibrated (steady-state vibration), the sound pressure characteristic is affected by the shape effect of the diaphragm including the domed diaphragm and the conical diaphragm. It is one of the important factors to determine the frequency characteristic of the loudspeaker. If other conditions such as material, voice coil and edge are the same, the shape effect is determined in dependency on the shape of the diaphragm, that is the height of the diaphragm.

Figure 5:
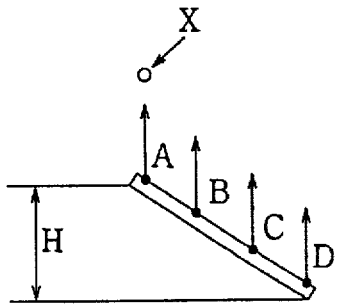
FIG. 5 is a schematic diagram showing a part of a conical diaphragm.

FIG. 5 shows a part of a domed diaphragm having a height H. References A, B, C and D are sound sources and X is a hearing point of the sound. By the height H, the distance between each of the sound sources A to D and the hearing point X is different from each other. Accordingly, there are cases where phases of the sounds radiated from the respective sound sources A to D are different from each other.

Figure 6:
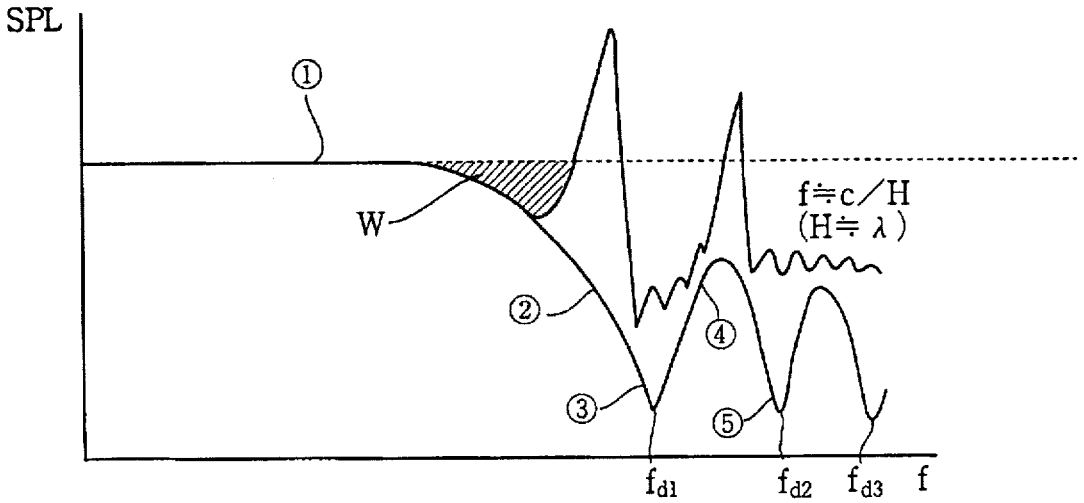
FIG. 6 is a diagram for explaining a sound pressure characteristic of a loudspeaker using the conical diaphragm of FIG. 5.

FIG. 6 shows a sound pressure characteristic of the domed diaphragm. In a low frequency range, the sound pressure characteristic has a flat frequency characteristic. In a high frequency range, the sound pressure characteristic is decreased with periodical dip frequencies fd1, fd2, fd3 . . . . The sound pressure characteristic is determined in accordance with the relationship between the height H of the diaphragm and the wavelength $\lambda$ of the sound.

If $\lambda >> H$, which means that the sound is in a very low frequency range, the sound radiated from each of the sound sources A to D has the same phase so that the sound pressure has a flat characteristic. The sound pressure characteristic is shown by a curve ① of FIG. 6. In low and middle frequency ranges, the diaphragm vibrates in the steady state.

If the wavelength becomes short (higher frequency) ($\lambda > H$), the phases of the sound are shifted, so that some of the sounds are cancelled, hence the sound pressure characteristic is decreased in an area W of FIG. 6. However, the diaphragm is still vibrated in the steady state.

Figure 7A:
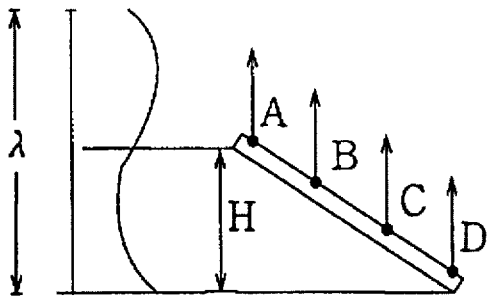
FIGS. 7*a* and 7*b* are diagrams showing a part of the conical diaphragm and phase differences of sounds radiated from the conical diaphragm relative to a height of the diaphragm and a wavelength of the sound.
Figure 7B:
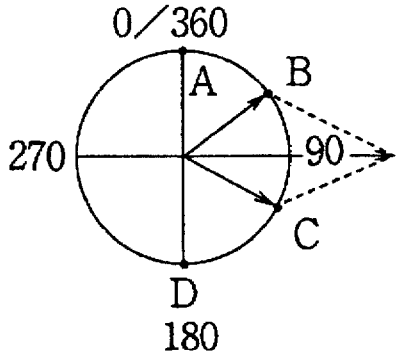

FIGS. 7*a* and 7*b* are diagrams showing the wavelength $\lambda = 2H$ and the phases of the sounds. The sounds radiated from each of the sound sources A and D has an opposite phase to be cancelled with each other. The sounds from the sound sources B and C are composed and vectors thereof become the sound pressure characteristic shown by a curve ② of FIG. 6. The curve ② is decreased compared with the curve ①.

Thereafter, since disorder and partial vibrations occur, the sound pressure further decreases.

Figure 8A:
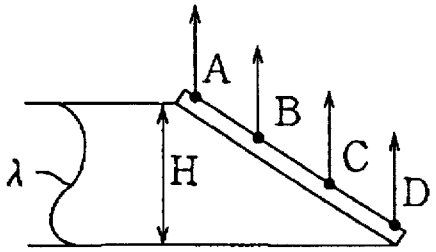
FIGS. 8*a* and 8*b* are diagrams showing another example of FIGS. 7*a* and 7*b;*
Figure 8B:
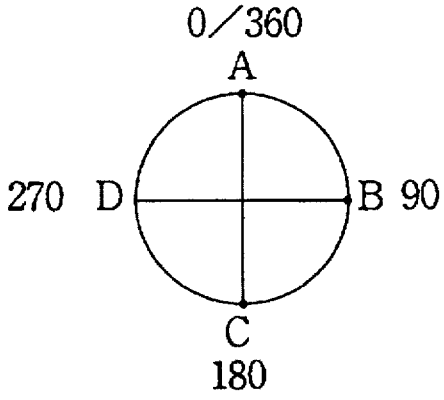

As shown in FIGS. 8*a* and 8*b*, if $\lambda = H$, the sounds from the sound sources A and C are opposite phases and the sounds from the sound sources B and D are opposite phases so that all sounds are canceled. The sound pressure is extremely decreased shown by a curve ③ of FIG. 6 to form a dip frequency. It is the initial lowest dip frequency fd1. This is the shape effect.

Figure 9A:
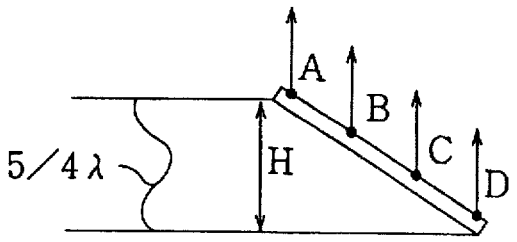
FIGS. 9*a* and 9*b* are diagrams showing a further example of FIGS. 7*a* and 7*b;*
Figure 9B:
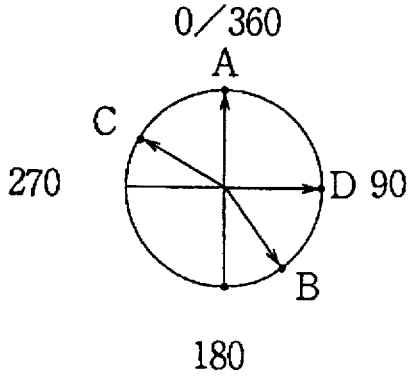

As shown in FIGS. 9*a* and 9*b*, if $5/4\lambda = H$, no sounds from the sound sources are opposed to each other, so that the sound pressure becomes larger as shown by a curve ④.

Figure 10A:
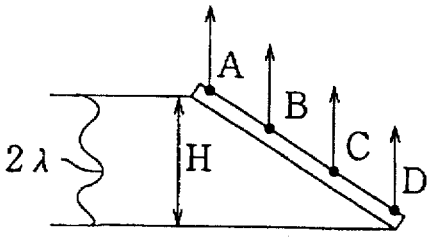
FIGS. 10*a* and 10*b* are diagrams showing a still further example of FIGS. 7*a* and 7*b;*
Figure 10B:
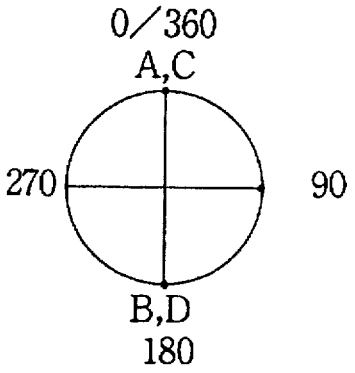

Referring to FIGS. 10*a* and 10*b*, if $2\lambda = H$, sounds from the sound sources A and C are opposite phase, and sounds from the sound sources B and D are opposite phase, so that all sounds are canceled with each other. Consequently, the sound pressure decreases shown by a curve ⑤ of FIG. 6 to a dip frequency fd2. The dip frequency is appeared periodically when $3\lambda = H$, $4\lambda = H$ . . . .

From the foregoing, it will be understood that since the initial dip fd1 generates when $\lambda = H$, if the height H is reduced, the dip frequency fd1 is shifted to a more higher frequency. In other words, the initial dip frequency fd1 moves with the height H.

In the loudspeaker having the domed diaphragm and the conical diaphragm of the present invention, the domed at the diaphragm mainly operates in a low frequency range, and the conical diaphragm actively operates in a high frequency range higher than the high limit frequency fh. For ensuring the operation, the domed diaphragm 20 has a weight (an area) heavier (larger) than that of the conical diaphragm 21.

Figure 11A:
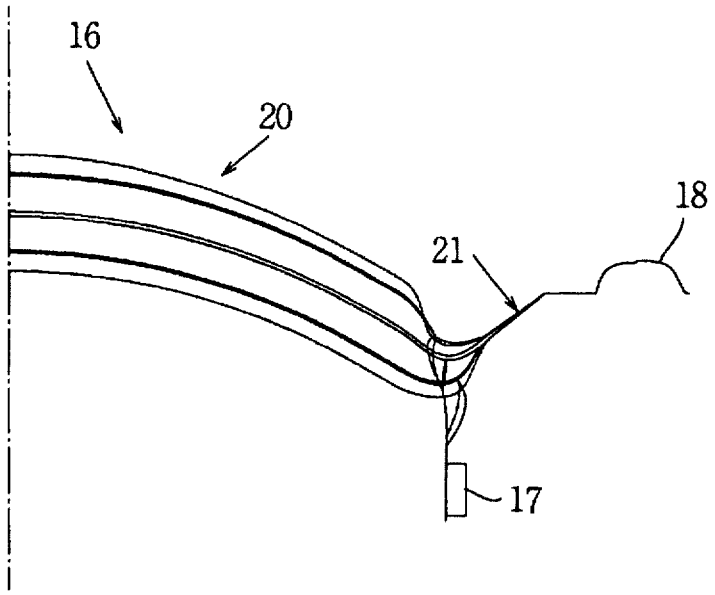
FIGS. 11*a* and 11*b* are diagrams showing simulations of vibrating operations of the diaphragms of the present invention.
Figure 11B:
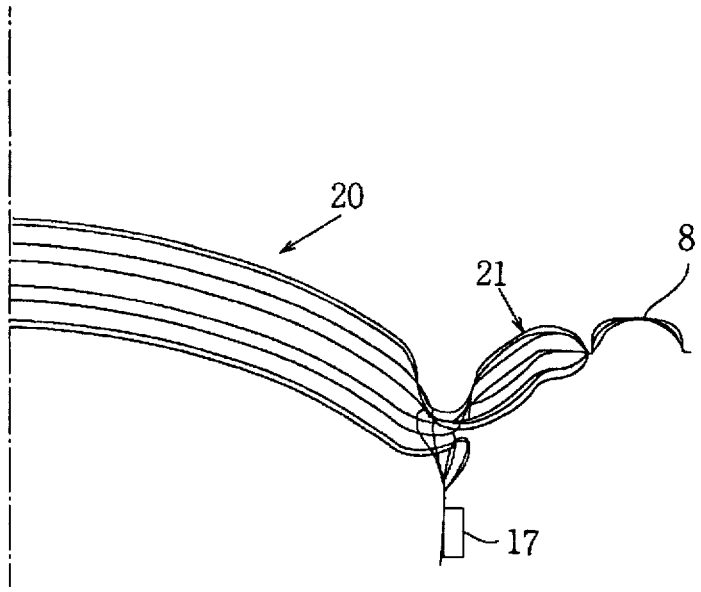

FIGS. 11*a* and 11*b* show simulations of the diaphragm unit 16 where the domed diaphragm 20 is actively vibrated in a frequency range lower than the high limit frequency fh.

Figure 12A:
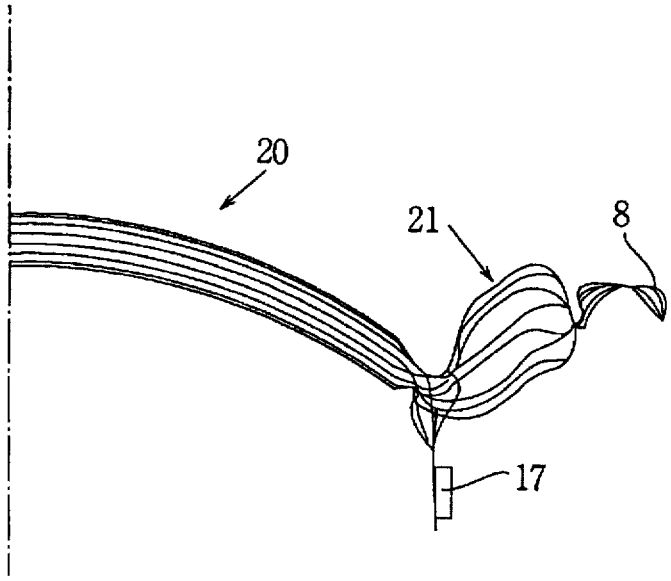
FIGS. 12*a* and 12*b* are diagrams showing other simulations of the vibrating operations of the diaphragms.
Figure 12B:
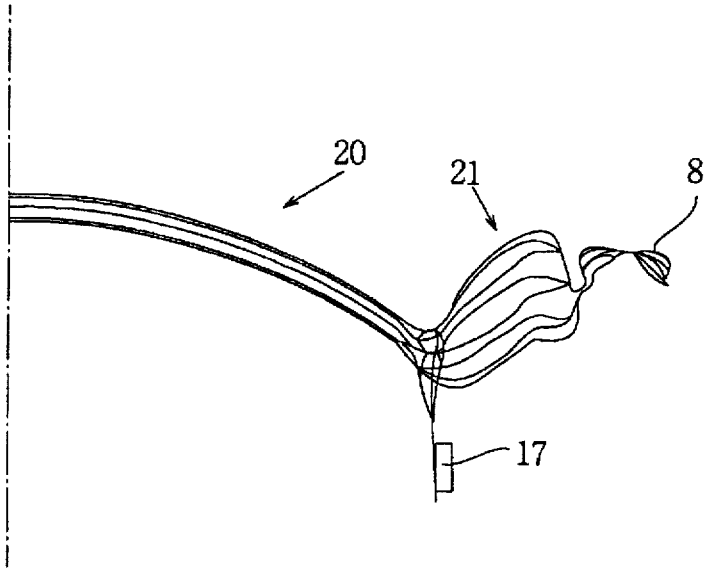

FIGS. 12*a* and 12*b* show simulations of the diaphragm unit where the conical diaphragm 21 is actively vibrated in a frequency range higher than the frequency fh.

If the weight of the domed diaphragm 20 is lighter than the conical diaphragm 21, the domed diaphragm 20 is actively vibrated in the higher frequency range, while the conical diaphragm 21 is actively vibrated at the lower frequency range. Therefore, the two-way operation is not properly performed, so that the sound pressure characteristic of the domed diaphragm can not be supplemented by the sound pressure characteristic of the conical diaphragm.

The diaphragm of the present invention is manufactured as follows.

(1) The high limit frequency fh of the dome characteristic is presumed.

(2) The height H of the conical diaphragm is set such that the initial dip frequency fd1 by the shape effect of the conical diaphragm is shifted to the range higher than the frequency fh.

As aforementioned, the sound pressure characteristic of the conical diaphragm has a sufficient sound pressure characteristic in a range lower than the initial dip frequency df1 and is gradually decreased in a higher range than the dip frequency fd1. Thus, the deterioration of the sound pressure characteristic of the dome characteristic is supplemented by the conical diaphragm characteristic in the higher range than the frequency fh.

(3) The sound pressure characteristic of the loudspeaker is examined. If a desired sound pressure characteristic is not obtained, either the frequency fh is reset at (1) by changing the shape of the domed diaphragm, or the height H is reset at (2).

Figure 13:
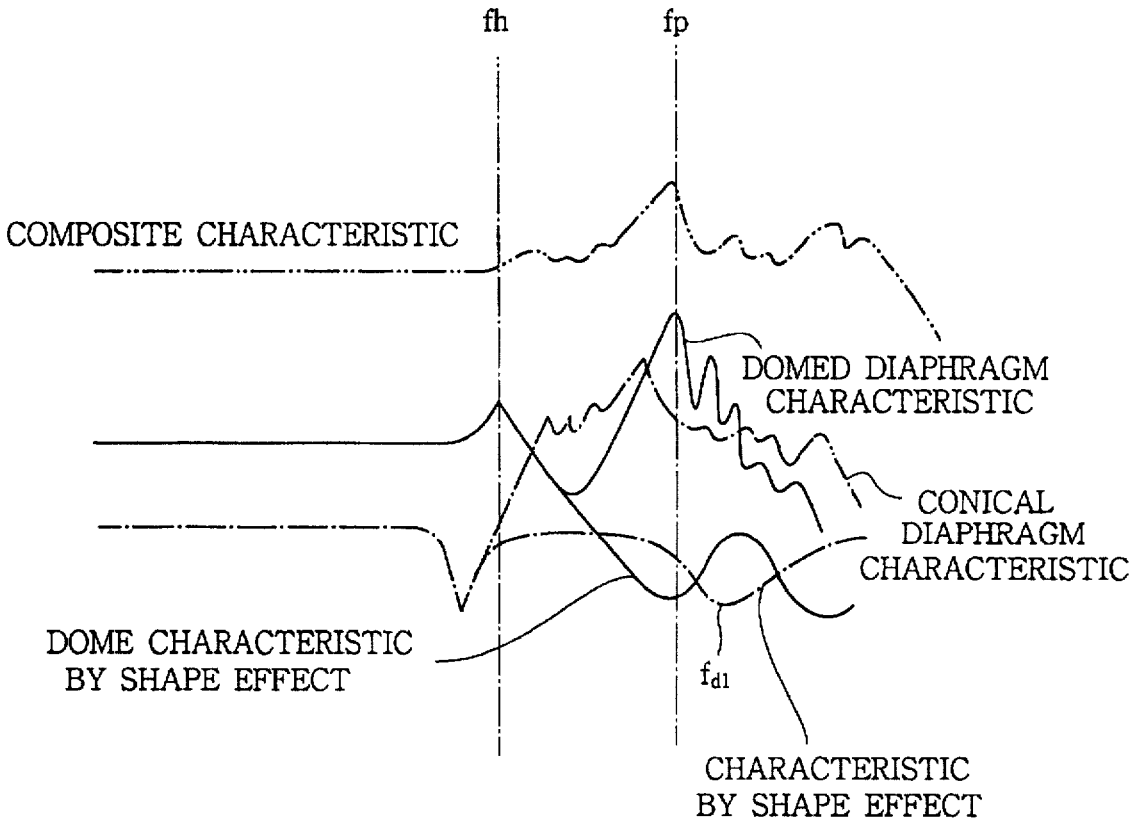
FIG. 13 is a diagram showing a sound pressure characteristic of the loudspeaker of the present invention.

FIG. 13 shows a sound pressure characteristic of the loudspeaker of the present invention. It will be seen that a total characteristic composed of the domed diaphragm characteristic and the conical diaphragm characteristic is increased in the higher frequency range, compared with the domed diaphragm characteristic. Furthermore, the peak of the partial resonance frequency fp is reduced.

If the characteristic of the domed diaphragm 20 is set in consideration of the dip frequency, a peak of the dome characteristic is also reduced.

Figure 14:
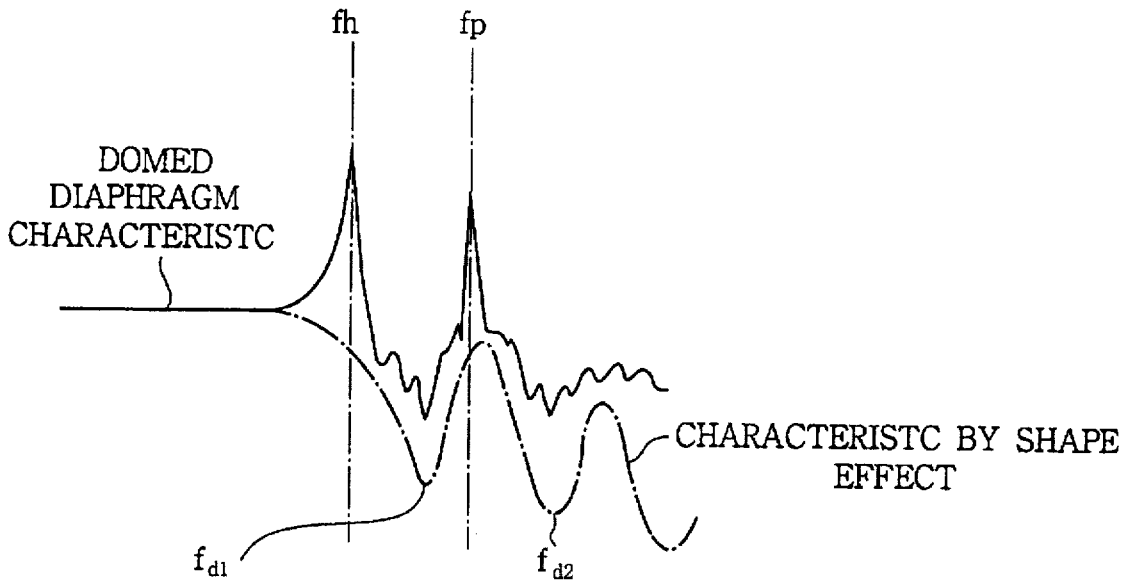
FIG. 14 is a diagram showing a sound pressure characteristic of a domed diaphragm.
Figure 15:
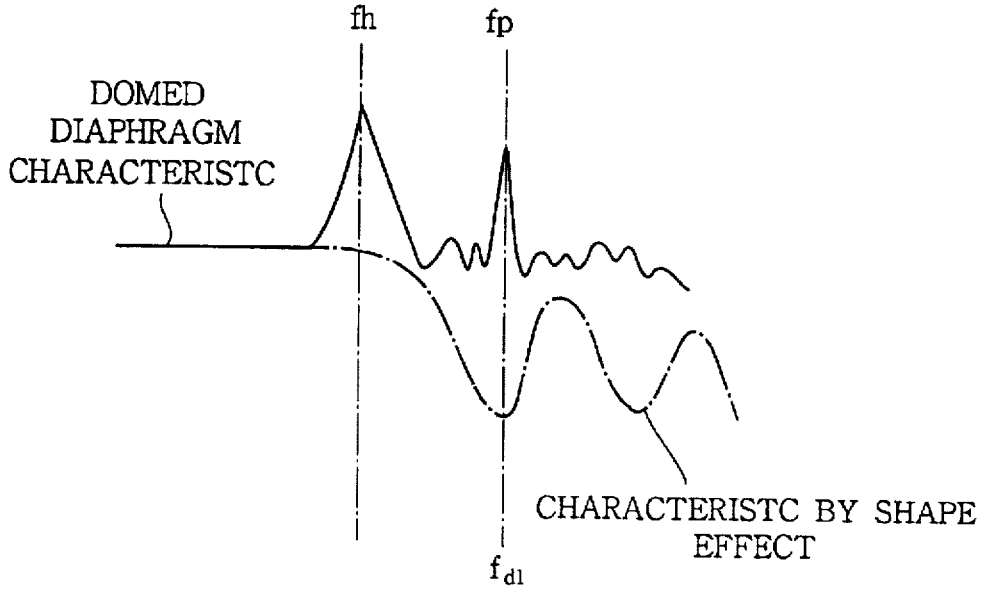
FIG. 15 is a diagram showing a composite sound pressure characteristic of the domed diaphragm.

FIG. 14 shows the domed diaphragm characteristic. The characteristic by the shape effect has a peak between the dip frequencies fd1 and fd2. If the dip frequency fd1 by the shape effect, in particular the lowest dip frequency is set to coincide with the resonance frequency fp as shown in FIG. 15, the peak is reduced, thereby providing a flat characteristic. Furthermore, it is preferable to locate a plurality of dip frequencies at resonance frequencies fp. If the dip frequency fd1 is positioned to coincide with the frequency fh, and dip frequency fd2 is positioned to coincide with the frequency fp, the peaks are more effectively reduced. In other words, it is also possible that a loudspeaker having only domed diaphragm without a conical diaphragm is made to have a flat high frequency characteristic by positioning the dip frequency at the peak frequency.

FIGS. 16*a* to 19*c* show simulations of the sound pressure characteristics of the loudspeaker of the present invention having different conditions.

Figure 16A:
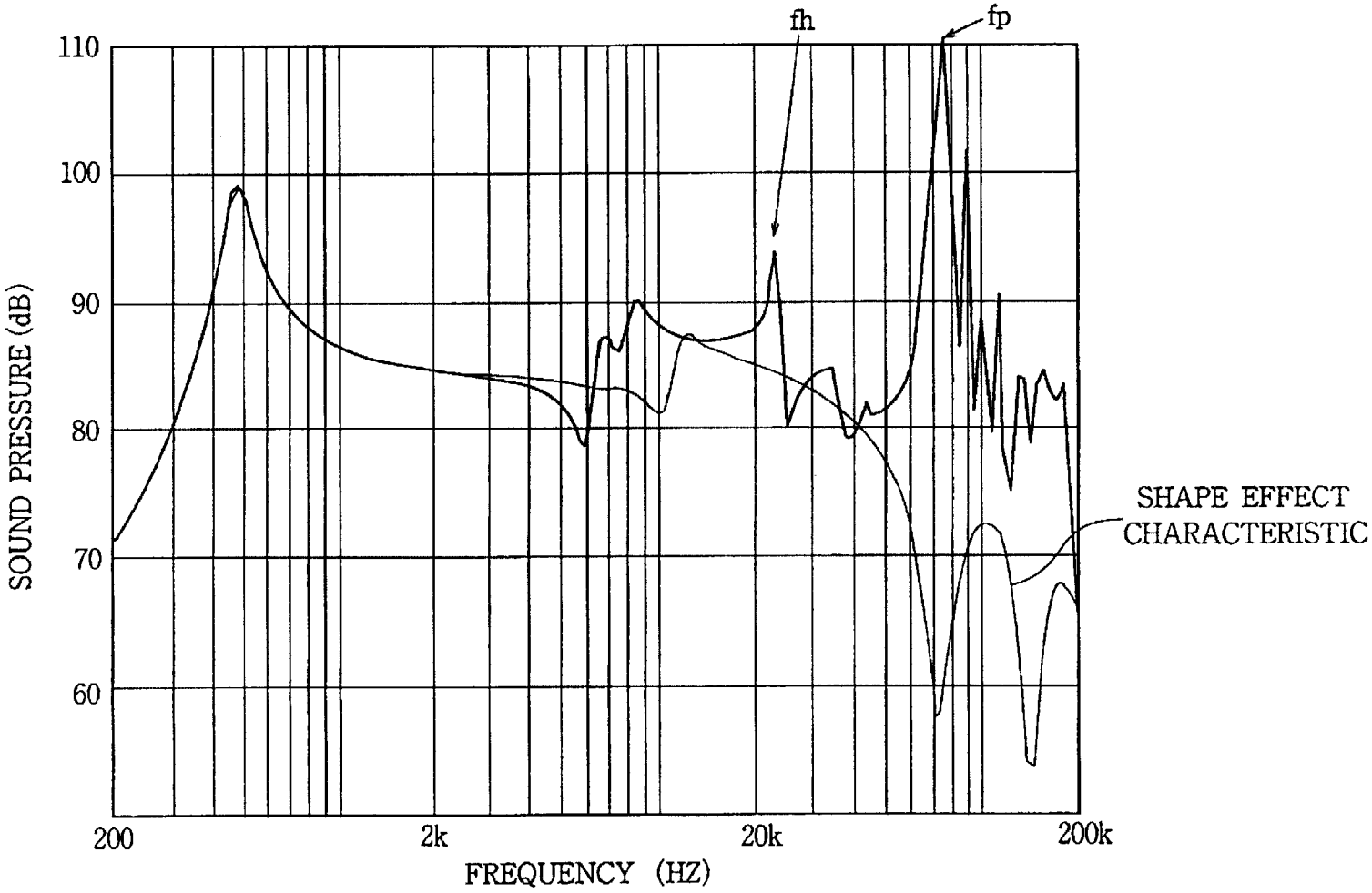
FIG. 16*a* is a diagram showing a sound pressure characteristic of a domed diaphragm of the loudspeaker of the present invention which is made of ceramics and has R20.
Figure 16B:
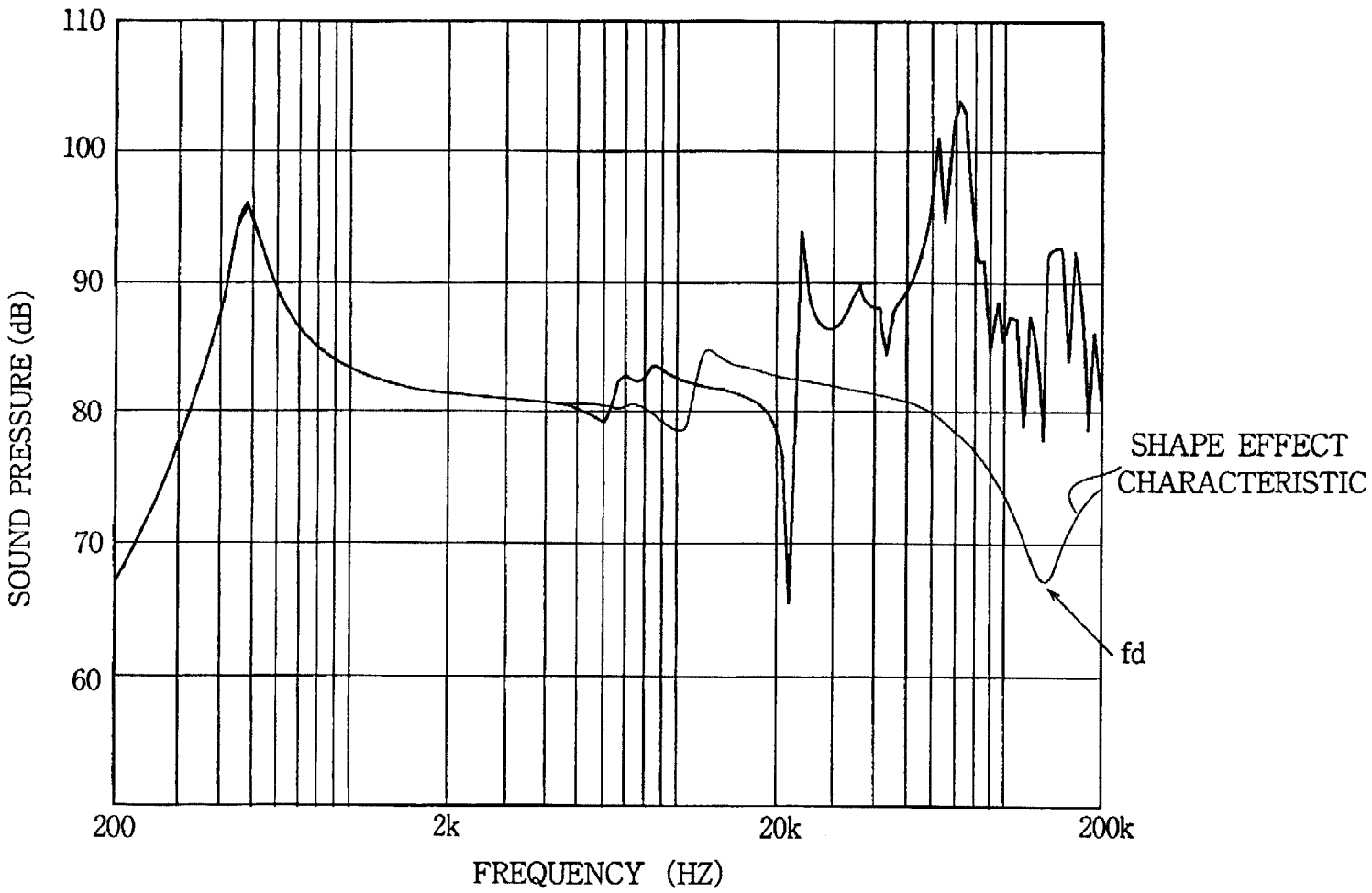
FIG. 16*b* is a diagram showing a sound pressure characteristic of a conical diaphragm of the loudspeaker of FIG. 16*a;*
Figure 16C:
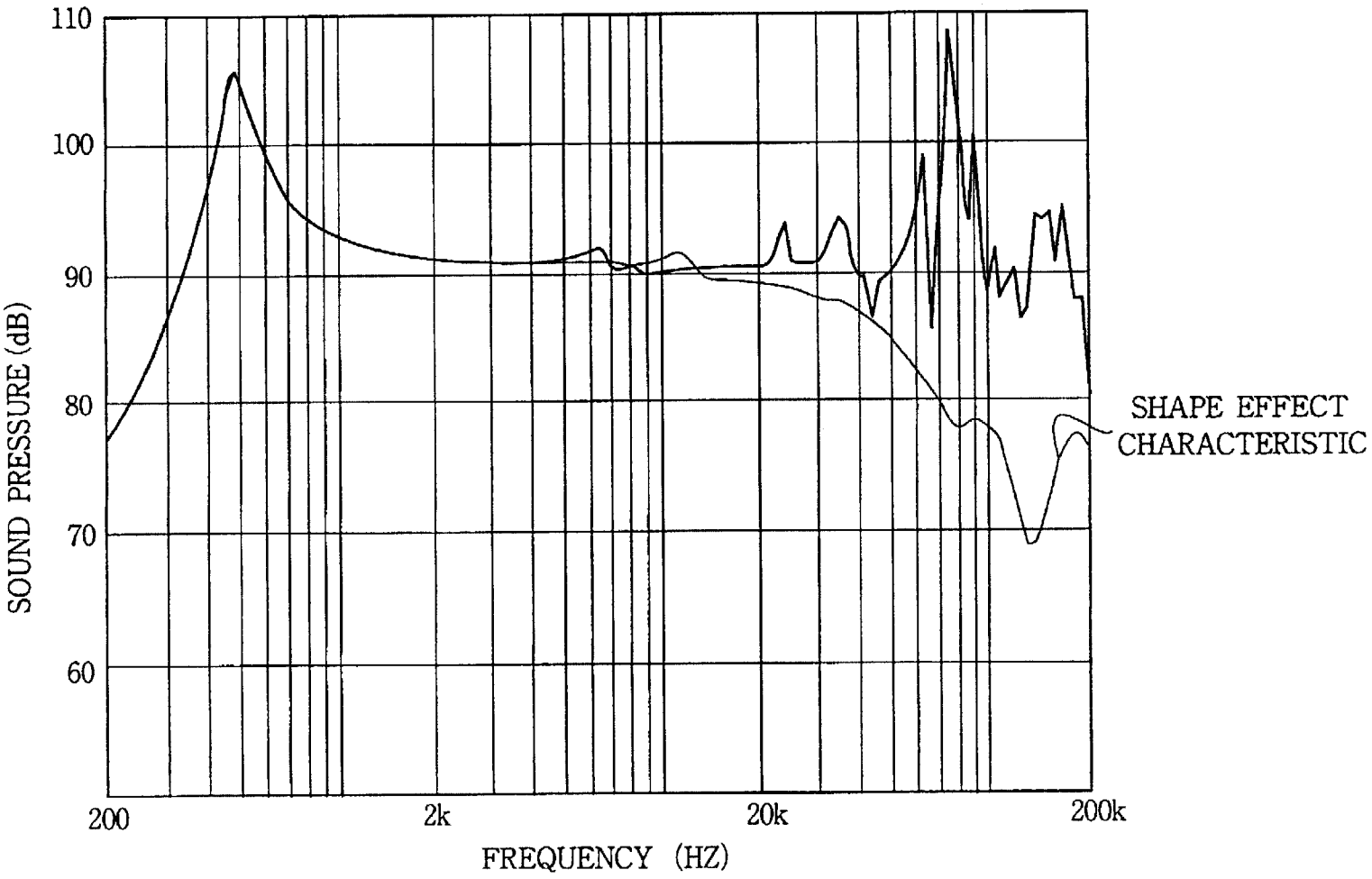
FIG. 16*c* is a diagram showing a composite sound pressure characteristic composed of dome characteristic and cone characteristic.

Referring to FIGS. 16*a*, 16*b* and 16*c*, the loudspeaker has a domed diaphragm 20 made of ceramics and having a radius of curvature of 20 mm. FIG. 16*a* shows the sound pressure characteristic of the domed diaphragm 20 including the shape effect characteristic thereof. FIG. 16*b* shows the sound pressure characteristic of the conical diaphragm 21 including the shape effect characteristic thereof. FIG. 16*c* shows the composite sound pressure characteristic composed of the sound pressure characteristics of the domed diaphragm 20 and conical diaphragm 21 of FIGS. 16*a* and 16*b*.

Figure 17A:
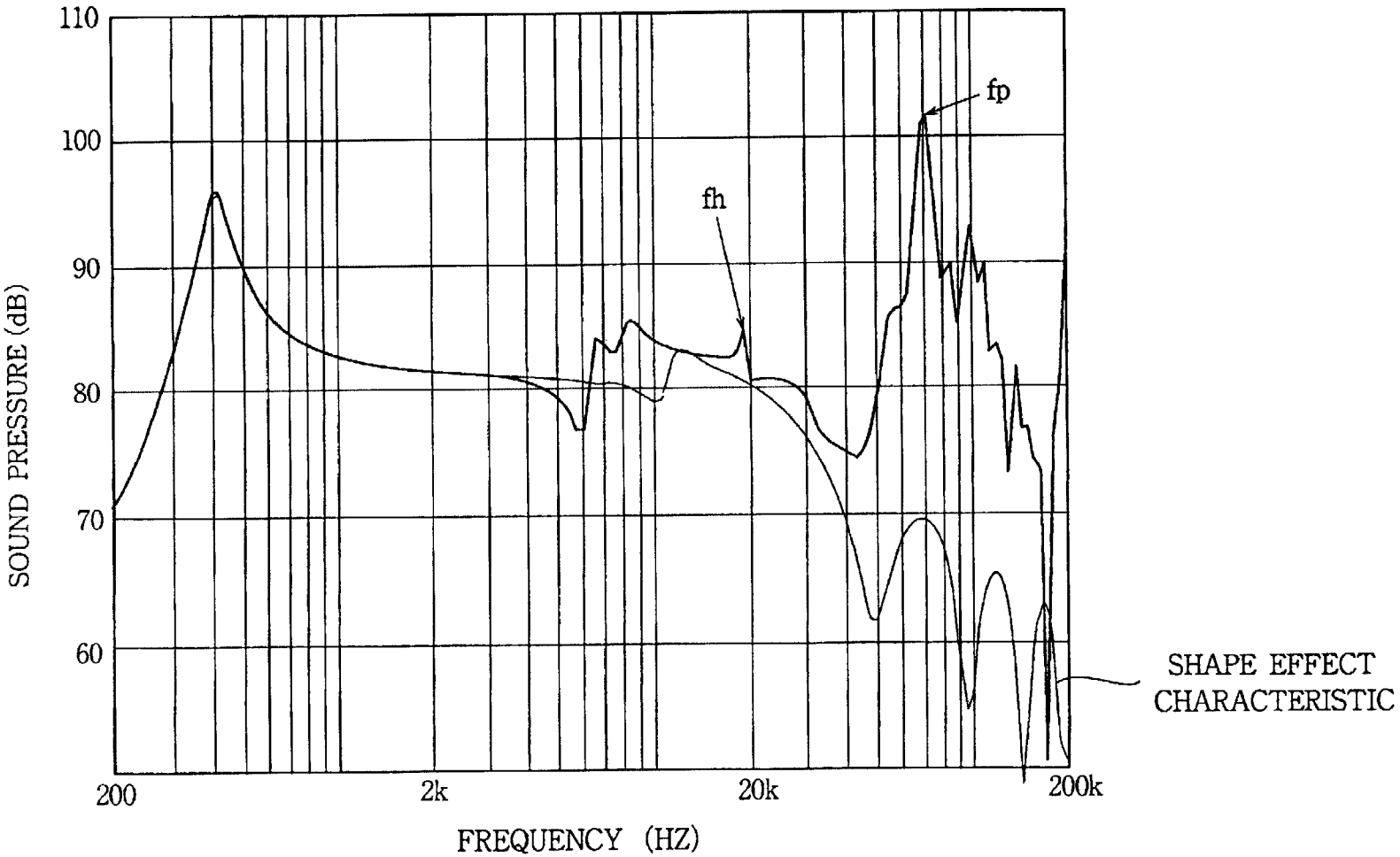
FIGS. 17*a*, 17*b* and 17*c* are diagrams showing sound pressure characteristics of another example of FIGS. 16*a* to 16*c*.
Figure 17B:
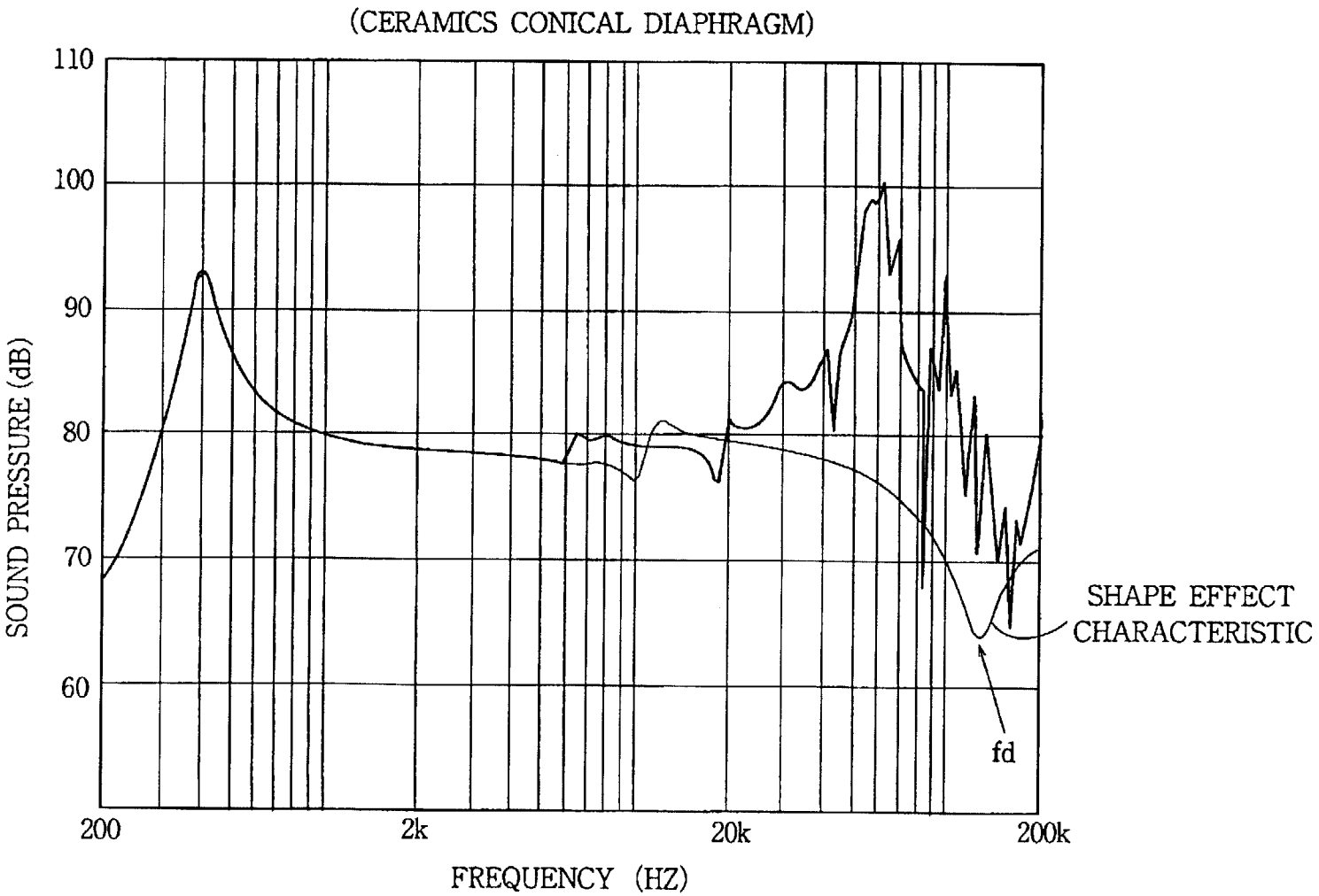
Figure 17C:
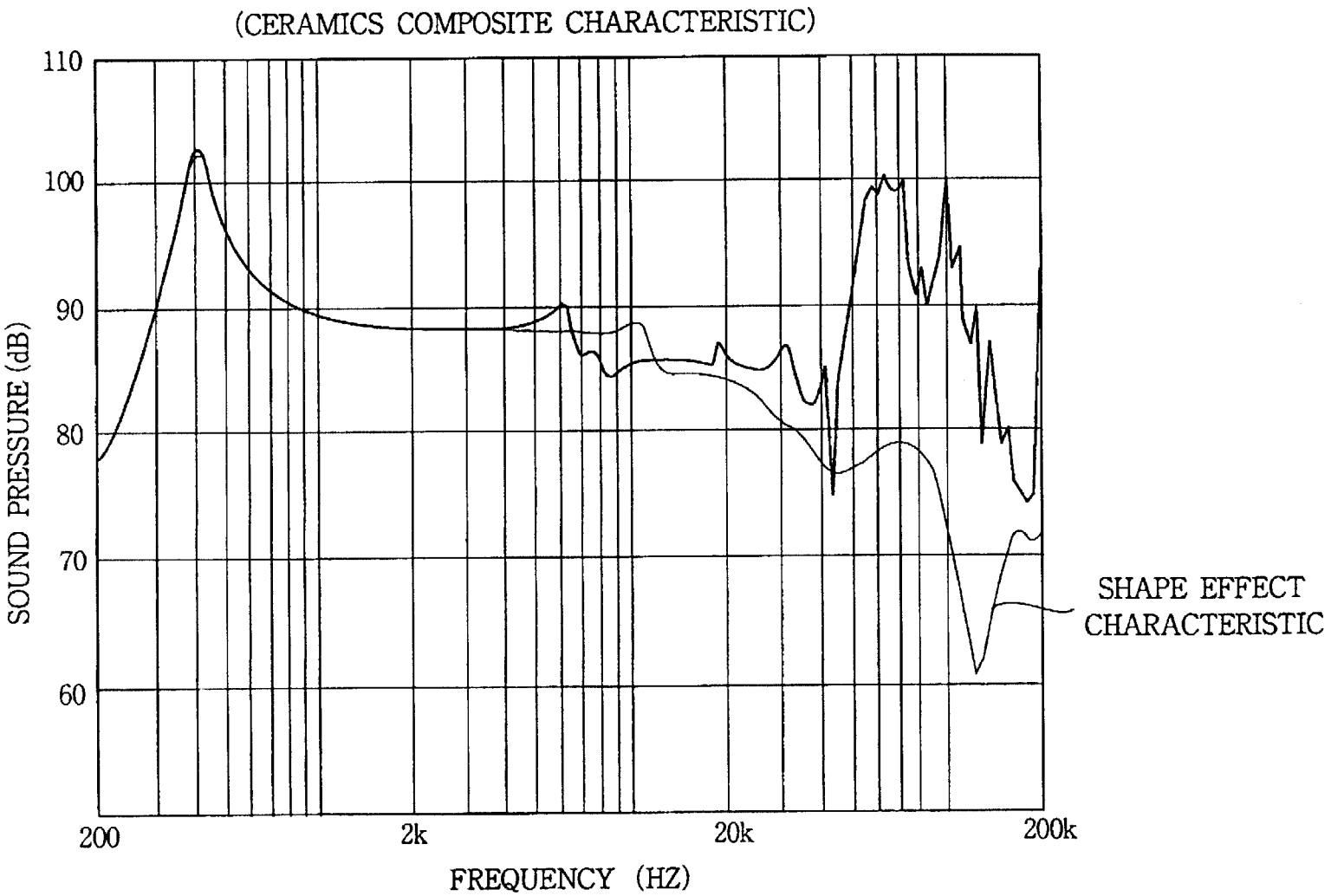

FIGS. 17*a*, 17*b* and 17*c* show the sound pressure characteristic of another loudspeaker of the present invention. The loudspeaker has a domed diaphragm made of ceramics and having a radius of curvature of 15 mm.

FIG. 17*a* shows the sound pressure characteristic of the domed diaphragm including the shape effect characteristic thereof. FIG. 17*b* shows the sound pressure characteristic of the conical diaphragm including the shape effect characteristic thereof. FIG. 17*c* shows the composite sound pressure characteristic composed of the sound pressure characteristics of the domed diaphragm and conical diaphragm of FIGS. 17*a* and 17*b*.

Figure 18A:
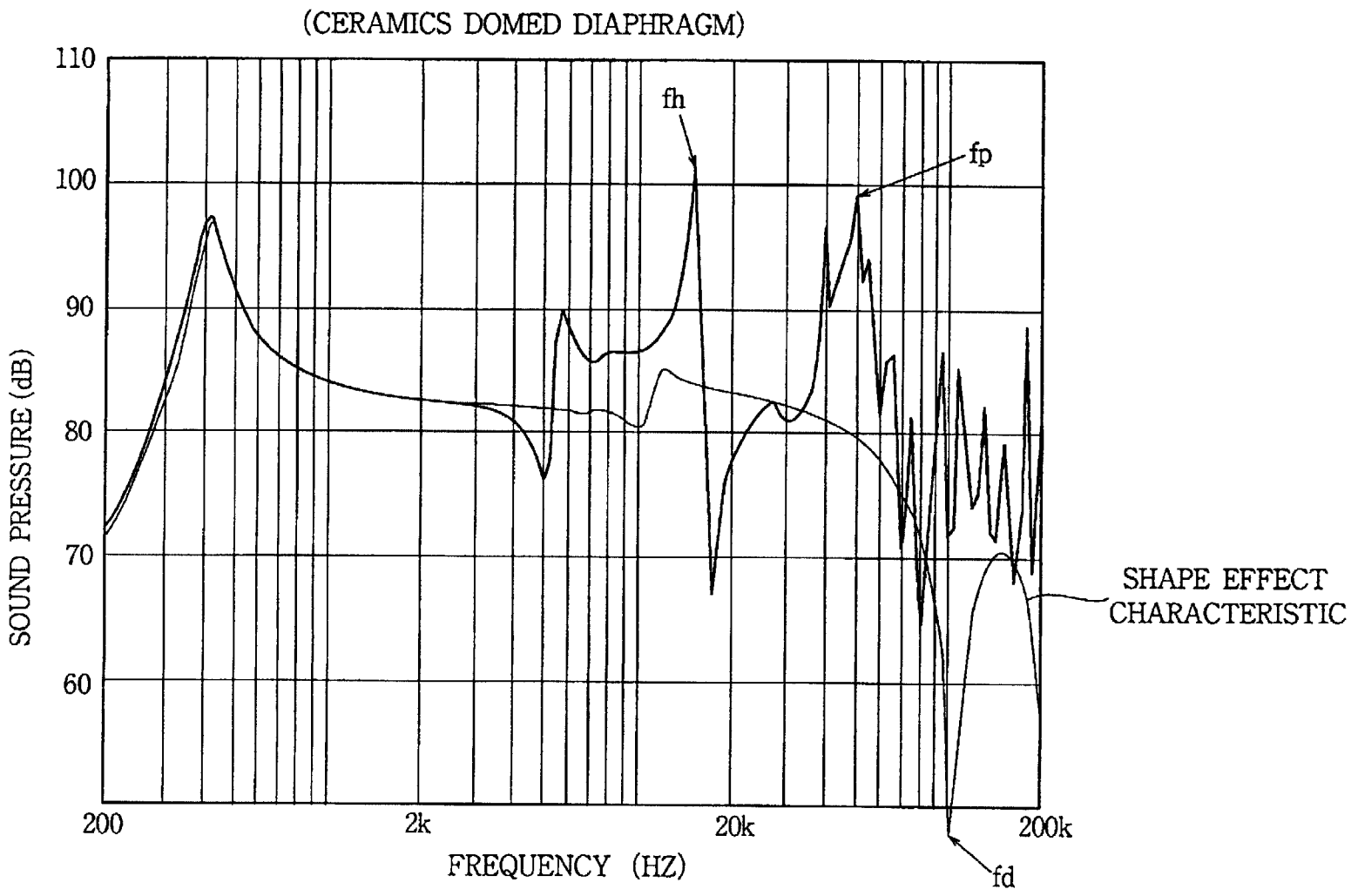
FIGS. 18*a*, 18*b* and 18*c* are diagrams showing sound pressure characteristics of a further example of FIGS. 16*a* to 16*c*.
Figure 18B:
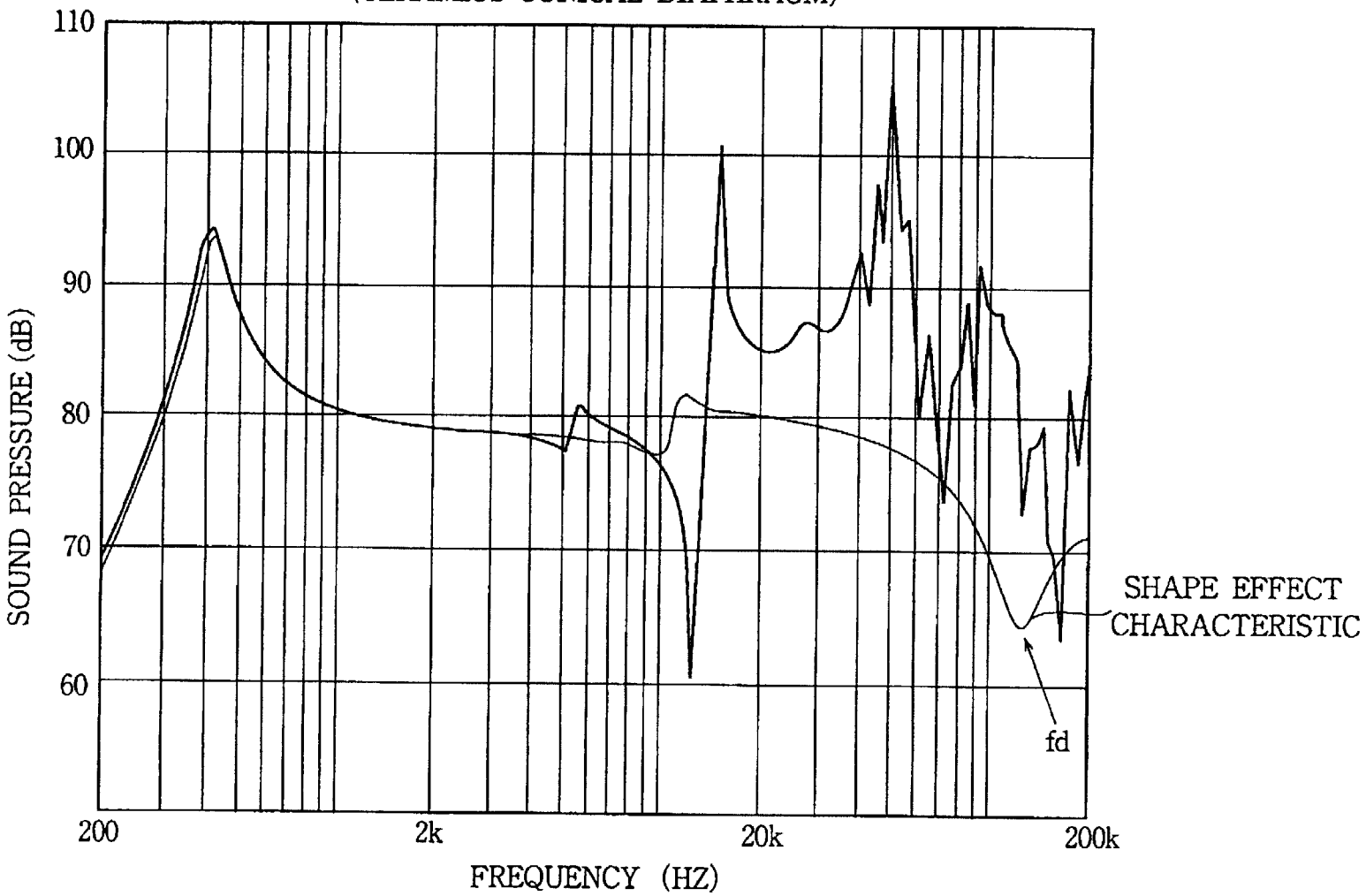
Figure 18C:
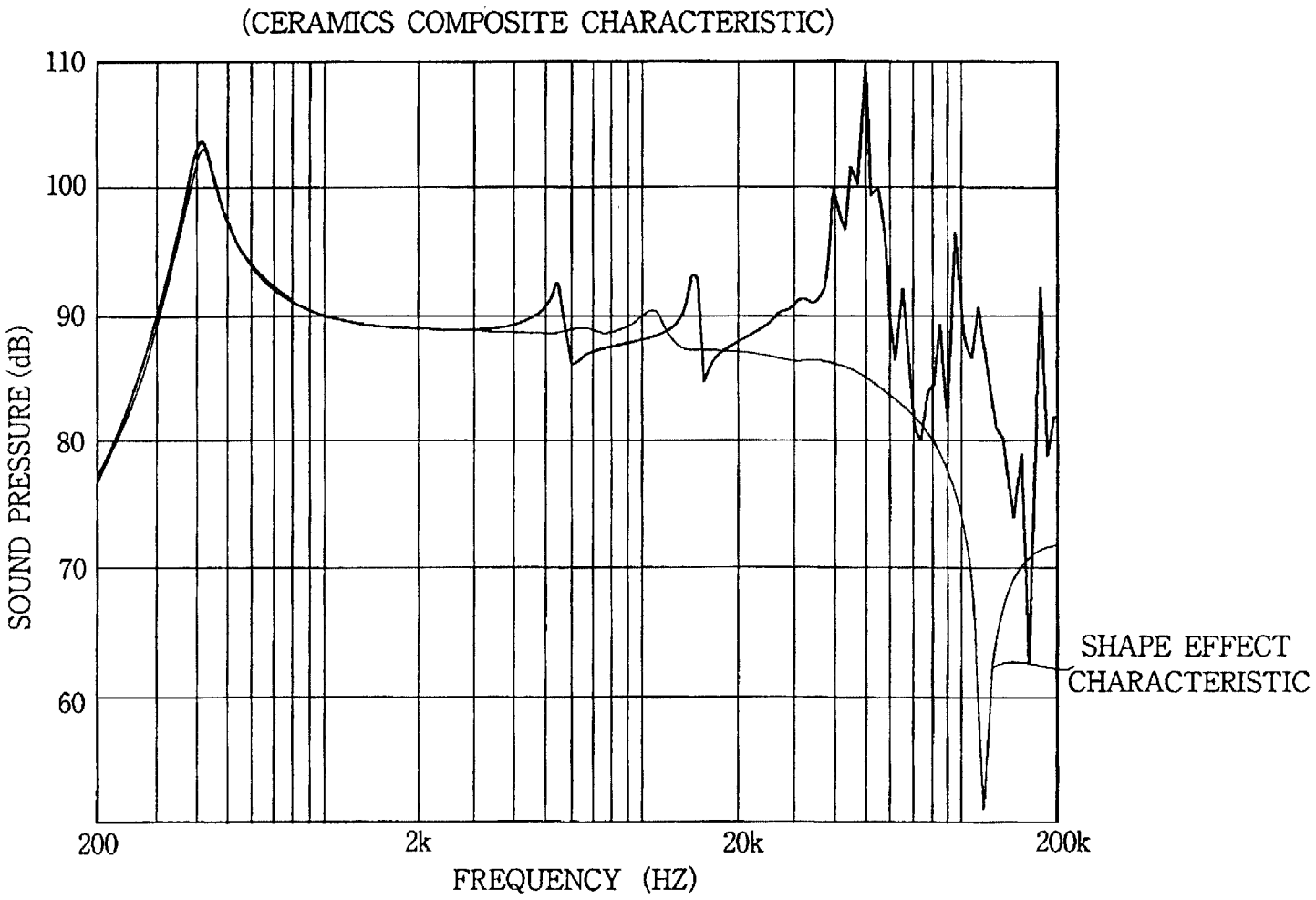

FIGS. 18*a*, 18*b* and 18*c* show the sound pressure characteristic of a further example of the loudspeaker of the present invention. The loudspeaker has a domed diaphragm made of ceramics and having a radius, of curvature of 27 mm. FIG. 18*a* shows the sound pressure characteristic of the domed diaphragm including the shape effect characteristic thereof. FIG. 18*b* shows the sound pressure characteristic of the conical diaphragm including the shape effect characteristic thereof. FIG. 18*c* shows the composite sound pressure characteristic composed of the sound pressure characteristics of the domed diaphragm and conical diaphragm of FIGS. 18*a* and 18*b*.

Figure 19A:
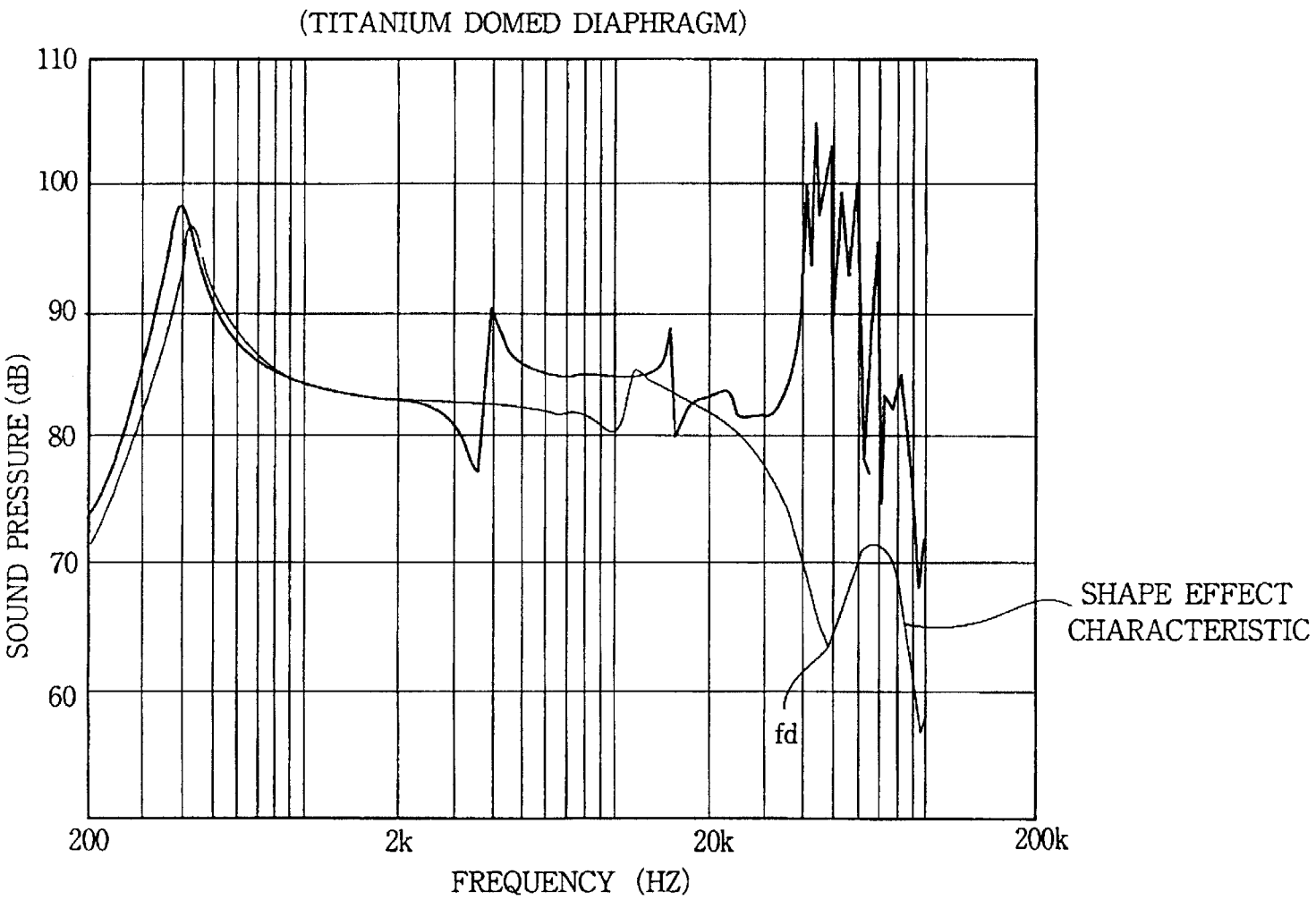
FIGS. 19*a*, 19*b* and 19*c* are diagrams showing sound pressure characteristics of a still further example of FIGS. 16*a* to 16*c*.
Figure 19B:
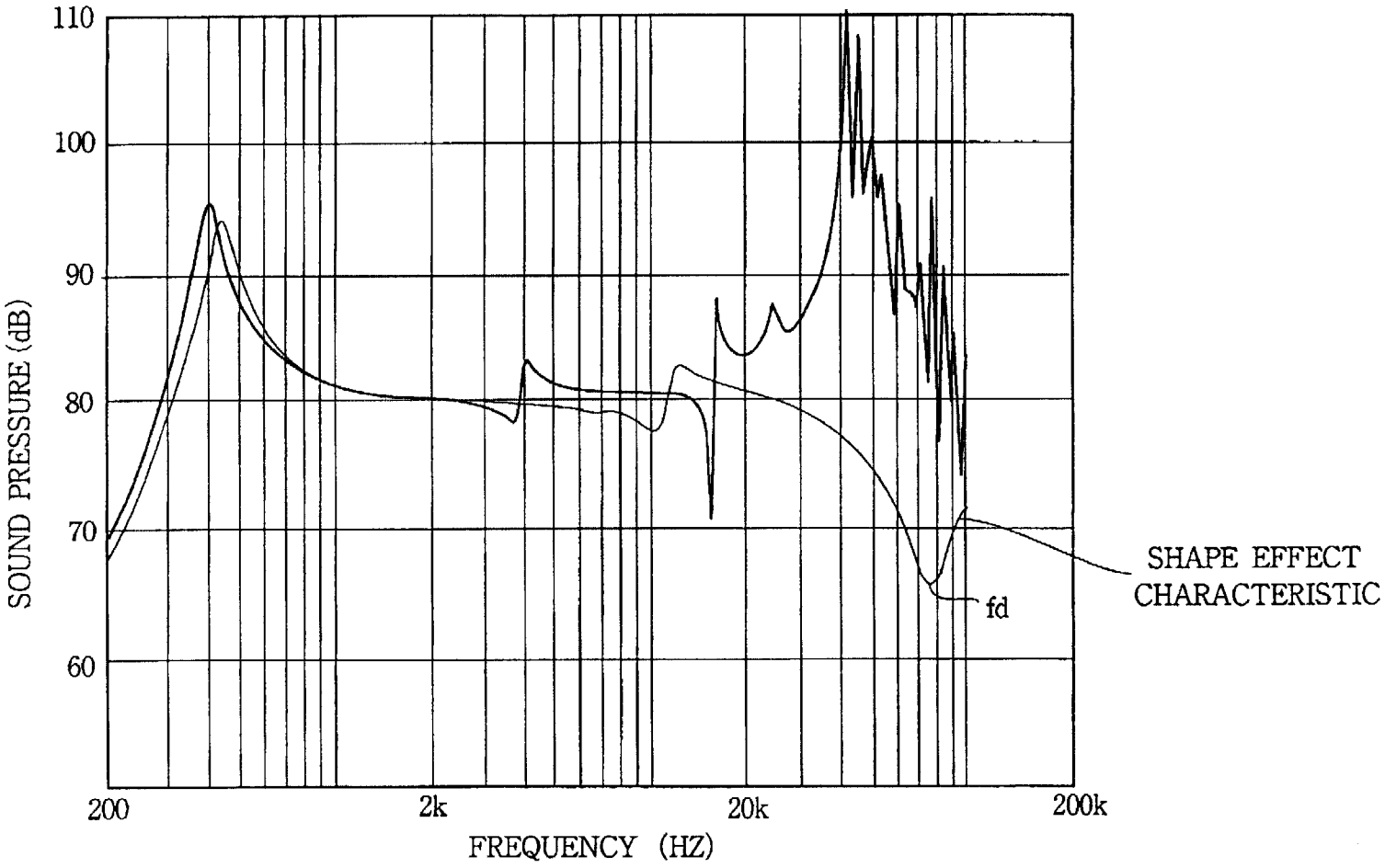
Figure 19C:
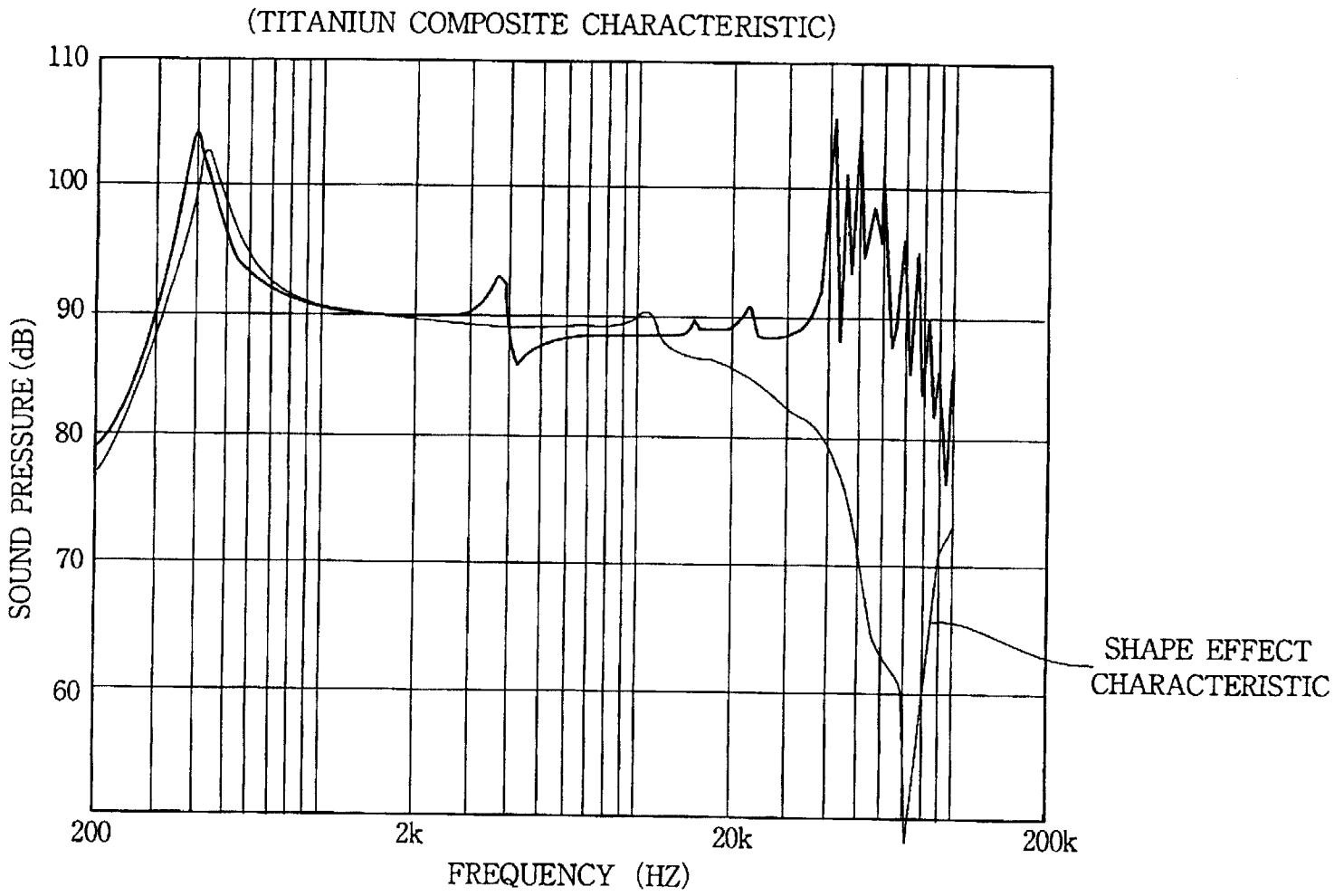

FIGS. 19*a*, 19*b* and 19*c* show the sound pressure characteristic of a still further example of the loudspeaker of the present invention. The loudspeaker has a domed diaphragm made of titanium and having a radius of curvature of 20 mm. FIG. 19*a* shows the sound pressure characteristic of the domed diaphragm including the shape effect characteristic thereof. FIG. 19*b* shows the sound pressure characteristic of the conical diaphragm including the shape effect characteristic thereof. FIG. 19*c* shows the composite sound pressure characteristic composed of the sound pressure characteristics of the domed diaphragm and conical diaphragm of FIGS. 19*a* and 19*b*.

In accordance with the present invention, since the deterioration of the sound pressure characteristic of the domed diaphragm is supplemented by the sound pressure characteristic of the conical diaphragm, the flat characteristic is obtained in a higher frequency range than the high limit frequency.

While the presently preferred embodiments of the present invention has been shown and described, it is to be understood that these disclosures are for the purpose of illustration and that various changes and modifications may be made without departing from the scope of the invention as set forth in the appended claims.

What is claimed is:

1. A loudspeaker for higher audio frequencies, comprising:

a first diaphragm having a domed shape;

a second diaphragm formed on a periphery of the first diaphragm and supported at a peripheral edge thereof;

a voice coil providing at a juncture of the first and second diaphragms;

the second diaphragm being designed such that a dip frequency by shape effect thereof is positioned at a frequency higher than a high limit frequency of the first diaphragm, whereby a total sound pressure characteristic becomes substantially flat.

2. A loudspeaker for higher audio frequencies, comprising:

a first diaphragm having a domed shape;

a second diaphragm formed on a periphery of the first diaphragm and supported at a peripheral edge thereof;

a voice coil provided at a juncture of the first and second diaphragm;

the first diaphragm having a weight larger than the second diaphragm;

said second diaphragm has such a height that a frequency corresponding to a wavelength equal to the height of the said second diaphragm is positioned at a frequency higher than the high limit frequency of the first diaphragm.

3. The loudspeaker according to claim 1 wherein the second diaphragm has an inverted conical shape.

4. The loudspeaker according to claim 1 wherein the first diaphragm has a weight larger than the second diaphragm.

5. The loudspeaker according to claim 3 wherein the second diaphragm has such a height that a frequency corresponding to a wavelength equal to the height of the second diaphragm is positioned at a frequency higher than the high limit frequency of the first diaphragm.

6. The loudspeaker according to claim 5 wherein the first diaphragm has a weight larger than the second diaphragm.

7. The loudspeaker according to claim 1, wherein a lowermost dip frequency by the shape effect of the second diaphragm is dependent on a height of the second diaphragm.

8. A loudspeaker for higher audio frequencies, comprising:

a first diaphragm having a domed shape;

a second diaphragm formed on a periphery of the first diaphragm and supported at a peripheral edge thereof;

a voice coil provided at a juncture of the first and second diaphragms;

the second diaphragm being designed such that a dip frequency by shape effect thereof is positioned at a frequency higher than a high limit frequency of the first diaphragm; and at least one frequency of dip frequencies by the shape effect of the first diaphragm being positioned so as to coincide with a partial resonance peak frequency caused by the first diaphragm.

9. The loudspeaker according to claim 8 wherein the first diaphragm has a weight larger than the second diaphragm.

* * * * *